United States Patent [19]

Hackett

[11] Patent Number: 4,840,513

[45] Date of Patent: Jun. 20, 1989

[54] SCAFFOLDING CONNECTOR APPARATUS

[76] Inventor: Steven B. Hackett, 17822 Arbor La., Irvine, Calif. 92705

[21] Appl. No.: 927,661

[22] Filed: Nov. 5, 1986

[51] Int. Cl.[4] ..... F16B 7/00; E04G 7/00

[52] U.S. Cl. ..... 403/49; 403/246; 403/298; 182/179

[58] Field of Search ..... 403/49, 174, 246, 374, 403/409.1, 189, 190, 292, 108, 328, 297, 298, 329; 182/179, 178

[56] References Cited

U.S. PATENT DOCUMENTS

| | | | |
|---|---|---|---|
| 2,496,082 | 1/1950 | Ashenfelter . | |
| 2,588,905 | 3/1952 | Blackburn . | |
| 3,000,656 | 9/1961 | Hollaender | 403/298 |
| 3,178,210 | 4/1965 | Dickinson | 403/292 |
| 3,179,212 | 4/1965 | Gostling . | |
| 3,300,236 | 1/1967 | Sauls . | |
| 3,420,557 | 1/1969 | Francis et al. . | |
| 3,707,304 | 12/1972 | Gostling . | |
| 3,817,641 | 6/1974 | Steele et al. . | |
| 3,879,143 | 4/1975 | Gostling . | |
| 3,880,533 | 4/1975 | Gostling . | |
| 3,901,609 | 4/1975 | Gostling . | |
| 3,926,531 | 12/1975 | Gostling . | |
| 3,975,106 | 8/1976 | Steele | 403/374 |
| 4,039,264 | 9/1977 | Sharp . | |
| 4,044,523 | 9/1977 | Layher . | |
| 4,083,640 | 4/1978 | Lovering . | |
| 4,095,910 | 6/1978 | Steele et al. . | |
| 4,180,342 | 12/1979 | Layher . | |
| 4,273,463 | 6/1981 | Dobersch . | |
| 4,348,128 | 9/1982 | Gostling | 403/49 |
| 4,369,859 | 1/1983 | Smits . | |
| 4,394,095 | 7/1983 | Layher . | |
| 4,405,254 | 9/1983 | Tooley . | |
| 4,493,578 | 1/1985 | D'Alessio | 403/49 |
| 4,587,786 | 5/1986 | Woods | 403/49 X |
| 4,619,541 | 10/1986 | Lovering | 403/49 |

FOREIGN PATENT DOCUMENTS

| | | | |
|---|---|---|---|
| 2533704 | 2/1976 | Fed. Rep. of Germany | 403/328 |
| 656903 | 1/1965 | France | 403/328 |
| 2496741 | 6/1982 | France | 182/179 |

OTHER PUBLICATIONS

Quick Erect Scaffold Pamphlet, Patent Scaffolding Co., Harsco Corp., 1982.

*Primary Examiner*—Andrew V. Kundrat
*Assistant Examiner*—Peter M. Cuomo
*Attorney, Agent, or Firm*—Knobbe, Martens, Olson & Bear

[57] ABSTRACT

A circular plate with a plurality of apertures therein surrounds a vertical upright member used in constructing a scaffolding. An end of either a horizontal or diagonal spacer member is joined to the upright by a tapered wedge which is passed through the aperture. A wedge support member is secured to the end of the spacer and comprises a pair of parallel legs which straddle the plate. Each of the legs has a slot therein to allow passage of the wedge. A U-shaped tooth depends from the upper leg and is shaped to conform to the perimeter of the aperture in the plate. Both the tooth and the aperture are tapered so that as the wedge is driven into the aperture, the tooth is forced into engagement with the perimeter of the aperture. Engagement between the tooth and the aperture prevents lateral movement of the spacer relative to the upright. Also disclosed is an elongated, hexagonal fitting which extends between abutting ends of two tubular segments of the upright member and maintains a vertical, coaxial orientation of the adjacent segments. The corners of the fitting are rounded and engage the interior of each upright segment to provide support with a minimum of friction.

31 Claims, 3 Drawing Sheets

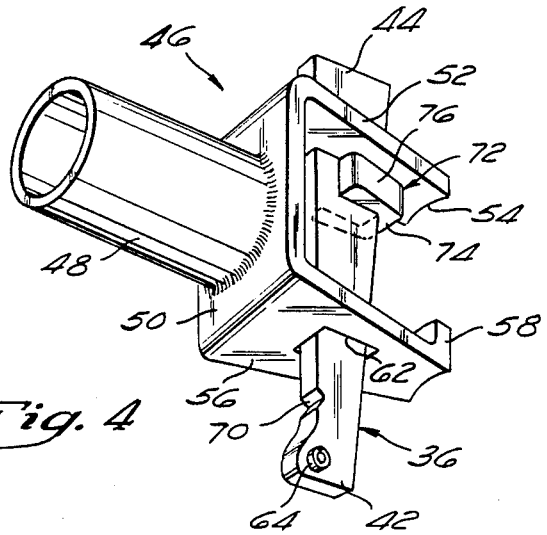
Fig. 4
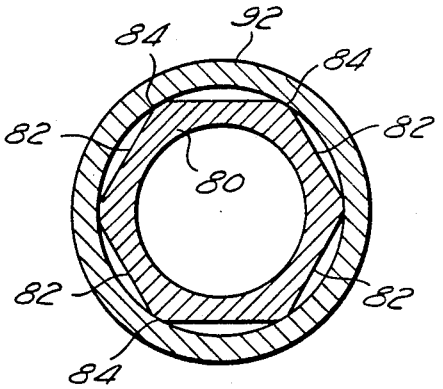
Fig. 10
Fig. 7
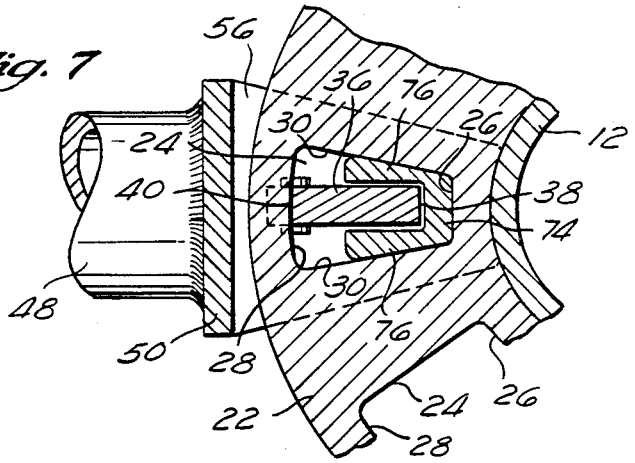
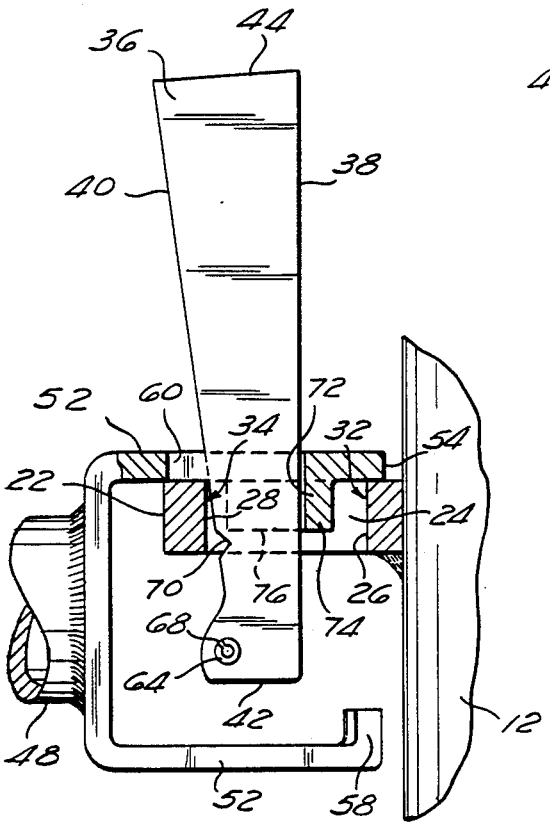
Fig. 5
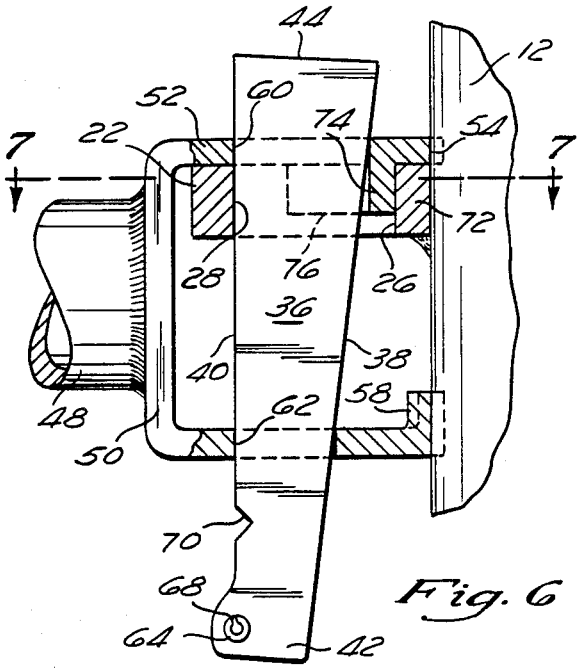
Fig. 6

92
94
98
84
80
82
88
86
92
96
90
12
24
24
22

23
92
84
80
82
10
10
88
98
96
86
90
92
12

38
36
40
54
60
70
52
50
46
64
48
58
62
56
24
22
24

SCAFFOLDING CONNECTOR APPARATUS

BACKGROUND OF THE INVENTION

The present invention relates generally to the field of scaffolding, and more particularly to an apparatus which is used to removably interconnect various components of a modular scaffolding system.

Scaffolding is used extensively in industry to provide temporary access to raised portions of a structure, such as a building or vessel under construction. A typical scaffolding system is comprised of a plurality of modular components which can be erected in a variety of configurations and dismantled for storage or transport. The basic components used in a scaffolding system are vertically oriented upright members and horizontally oriented spacers, which extend between the upright members. Diagonal spacer members may also be joined at either end to the uprights in order to maintain the rigidity of the scaffolding system. Generally, the spacers and uprights are elongate and tubular in construction. To form a horizontal surface on which workers can stand, a flat plank is placed across the horizontal spacers.

Various devices have been developed to removably interconnect the vertical uprights to the horizontal or diagonal spacers. Typically, the ends of the spacers include a tapered wedge which is slidably secured to the spacer in a manner to permit vertical motion of the wedge. To secure the spacer to the upright, the wedge is driven through a vertically oriented aperture in the upright, and is retained in place by frictional engagement with the aperture.

While these connectors have been satisfactory in terms of preventing the spacer and uprights from being pulled apart in a direction parallel to the longitudinal axis of the spacer, they have not been able to eliminate instability or wobbling of the scaffolding due to rotation of the spacer about the upright in either a horizontal or vertical plane. Another disadvantage of previous devices is that even though the spacer can be manipulated by a single worker, two workers are generally required to properly align each spacer with the uprights, thus increasing the time and labor required to erect the scaffolding. This is because the worker who is supporting and orienting the spacer usually grips the spacer proximate its mid-point, due to its length. As a result, that worker cannot get close enough to the wedge to visually inspect whether it is aligned with the aperture. Further, a second worker is often required to manually hold the wedge in a raised position, clear of the aperture, until alignment is achieved.

The vertical uprights are generally comprised of a plurality of tubular segments which are stacked end to end to reach a desired height. In order to secure adjacent segments, previous systems used a cylindrical fitting which had an outside diameter approximately equal to the inside diameter of the tubular upright segments. Each segment has an open or female end, and a male end at which the fitting is secured so as to protrude outwardly. Upon insertion of the male end or one segment into the female end of an adjacent segment, the contact between the fitting and the interior of the adjacent segment maintains the interconnected segments in a coaxial, vertical orientation.

A drawback to the cylindrical fittings is that in order to prevent relative motion between adjacent segments, a tight frictional fit must be maintained between the fitting and the inside diameter of the adjacent segment. Unfortunately, this interference between the fitting and the segment makes disassembly of the connected segments extremely difficult.

Thus, a need exists for a scaffolding connector which (1) removably secures a horizontal or diagonal spacer to a vertical upright without allowing relative motion between the spacer and upright; and (2) is easily aligned by a single worker. Additionally, a need exists for a fitting which securely interconnects adjacent upright segments yet easily allows dismantling of the interconnected segments.

SUMMARY OF THE INVENTION

The present invention comprises an apparatus for removably connecting a first member to a second member, wherein a plate is attached to the second member and includes at least one aperture therein. A tooth is mounted on the first member and extends at least partially into the aperture. Preferably, the aperture is tapered so as to form a narrow end and a wide end. The tooth conforms in size and shape to the narrow end of the aperture. Means are provided for driving the tooth into engagement with the perimeter of the narrow end of the aperture. Preferably, the driving means is a wedge which extends through the aperture and also through a wedge support member secured to the end of the first member. The tooth is mounted on the wedge support member. In the preferred embodiment, the apparatus is used to interconnect components of a scaffolding system. In particular, the first member comprises either a horizontal or diagonal spacer element, and the second element comprises a vertical upright member.

A key feature of the invention is that the engagement between the tooth and the aperture prevents lateral motion of the spacer, or rotation of the spacer about the upright in a horizontal plane. Additional stability is provided by the wedge support member, which preferably comprises a pair of vertically spaced legs which straddle the plate. Slots are provided through each of the legs to allow passage of the wedge. Both legs, upper and lower, directly engage the exterior of the upright member and thus provide a secure footing for the spacer so as to prevent rotation of the spacer relative to the upright in a vertical plane.

To enhance the stability of the footing provided by the legs, the ends of both legs which contact the upright conform in shape to the exterior of the upright. Moreover, the lower leg includes an upturned lip which increases the surface area of the lower leg in contact with the upright. The lip advantageously reduces the stress on the upright applied by the lower leg, enabling the scaffolding to withstand greater loads.

Another important feature of the invention is that the tooth enables the spacer and upright to be properly aligned without visual inspection, allowing a single worker to position the spacer so that the wedge is aligned for insertion into the aperture. The tooth drops into the aperture when the spacer is in the proper position, and this engagement between the tooth and aperture is ascertainable by a single worker who is holding the spacer, even if at a distance from the upright.

To further facilitate alignment of the wedge and the aperture, the wedge can be retained on the wedge support member in a tilted and raised position such that the wedge does not have to be manipulated while the spacer and upright are being aligned. A notch is provided in the wedge which engages the upper leg when the wedge is in the raised and tilted position. The notch prevents the wedge from sliding through the slot in the upper leg and into the aperture.

The wedge is retained on the wedge support member by a pin which protrudes through a hole in the wedge. The pin prevents the narrow end of the wedge from being pulled completely through the slot in the upper leg. The wide end of the wedge is too large to pass through the slot. Thus, the wedge is captive within the wedge support member and does not have to be handled separately from the spacer. However, the pin is removable so as to let the wedge pass through the slot for repair or replacement.

Another aspect of the present invention is a fitting which enables segments of the vertical upright to be stacked vertically in an end to end fashion. The fitting has a plurality of substantially planar sides which are joined by rounded corners. Preferably, the fitting is hexagonal in cross section. The outside diameter of the fitting is approximately equal to the inside diameter of the cylindrical, tubular upright segments. The fitting spans the joint between abutting end surfaces of the adjacent upright segments. Since the fitting contacts the upright segments at each corner of the fitting, the segments are maintained in a coaxial relationship. However, the total surface area of engagement between the hexagonal fitting and the interior of the upright segments is relatively small, and thus the friction generated between the fitting and the segments is minimized, facilitating disassembly of interconnected upright segments.

BRIEF DESCRIPTION OF THE DRAWINGS

FIG. 4 is a bottom perspective view of the wedge support member and wedge shown in FIGS. 2 and 3.

FIG. 5 is a partial cross-sectional side elevation of the present connector during insertion of a wedge.

FIG. 6 is a partial cross-sectional side elevation of the present connector, in a fully assembled position.

FIG. 7 is a cross-sectional view of the connector shown in FIG. 6, taken along line 7—7.

FIG. 10 is a cross-sectional view of the assembly shown in FIG. 8, taken along line 10—10.

DETAILED DESCRIPTION OF A PREFERRED EMBODIMENT

Figure 1:
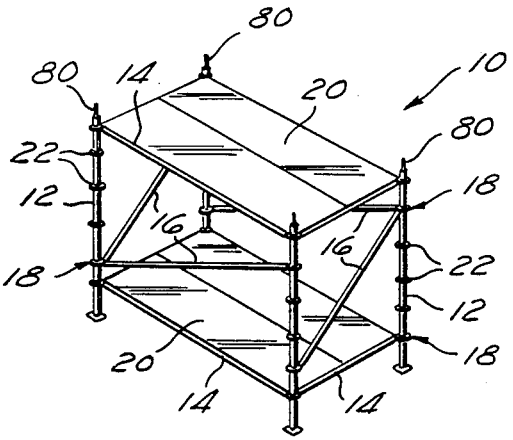
FIG. 1 is a perspective view of an assembled scaffolding structure utilizing the present scaffolding connector apparatus.

Referring to FIG. 1, an erected scaffolding system 10 is shown. The scaffolding 10 has a rectangular outline when viewed from above. An elongated, vertically upright member 12 is provided at each of the four corners of the scaffolding 10. A plurality of horizontally-oriented spacer members 14 extend between the uprights 12, forming the sides of the rectangular shape of the scaffolding 10. Elongated diagonally oriented spacers 16 also extend between the uprights 12, and are secured thereto at either end. The spacers 14,16 are joined to the uprights 12 by means of the present connector 18. A flat plank 20 extends across the horizontal spacers 14 to form a raised, horizontal surface on which workers (not shown) can stand. Preferably, the uprights 12, and spacers 14,16 are cylindrical, tubular, and formed from metal.

Figure 2:
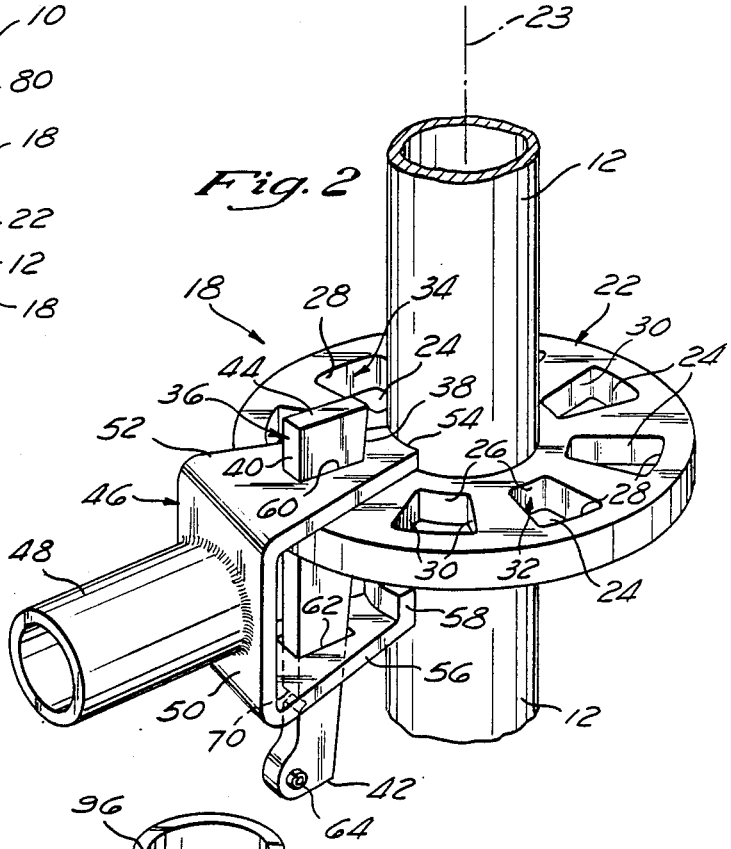
FIG. 2 is an enlarged perspective view of the present scaffolding connector shown in FIG. 1, in a fully-assembled position.
Figure 3:
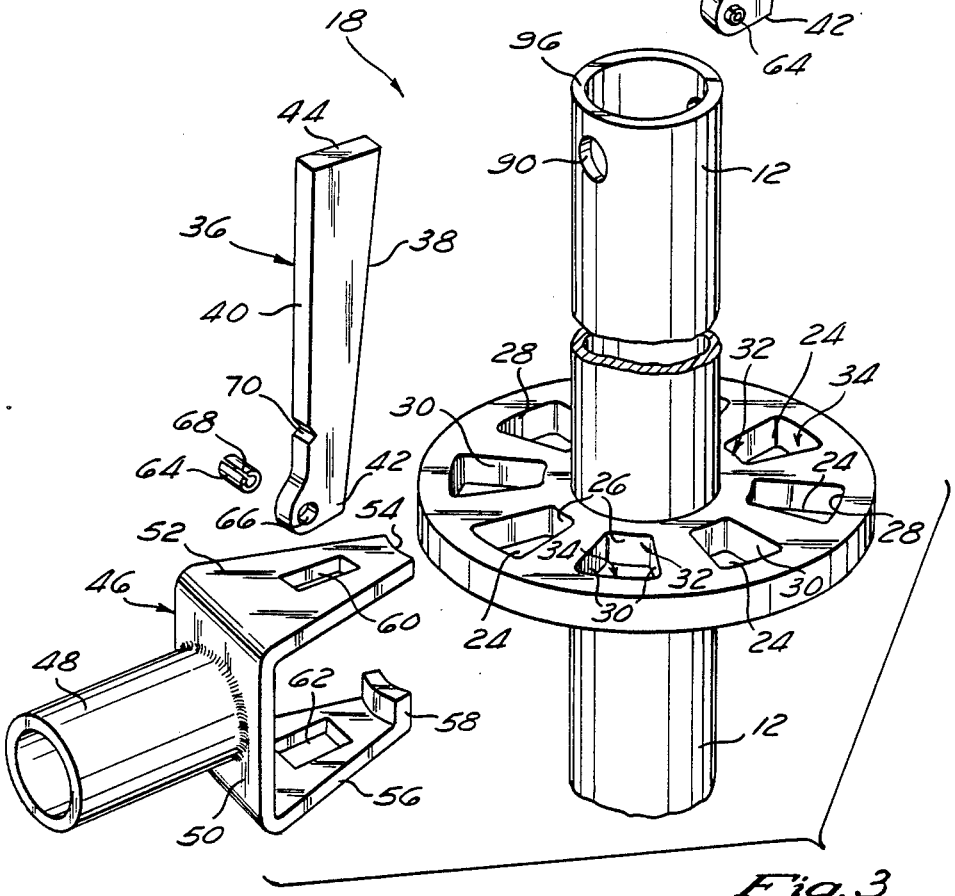
FIG. 3 is an exploded view of the connector shown in FIG. 2.

The present connector 18 is shown in more detail in FIGS. 2 and 3. One component of the connector 18 is an annular plate 22 which surrounds the exterior of the upright 12. As seen in FIG. 1, a number of plates 22 are fixed at intervals along the length of each upright 12. The plate 22 is substantially planar and is oriented horizontally, or normal to a longitudinal axis 23 of the upright 12. The plate 22 includes a plurality of apertures 24 which extend completely through the plate 22 in a vertical direction, or parallel to the upright 12. The apertures 24 are spaced in a circular array which surrounds the upright 12. The perimeter of each aperture 24 is trapezoidal in shape, and is defined by radially inner edge 26, a radially outer edge 28, and by a pair of side edges 30. The inner and outer edges 26,28 are opposed and substantially parallel, and the radial inner edge 26 is the shorter of the two. The side edges 30 connect the inner edge 26 and the outer edge 28 and are tapered in a radially inward direction. Due to the taper of the side edges 30, the inner edge 26 defines a narrow end 32 of the aperture 24. Conversely, the outer edge 28 defines a wide end 34 of the aperture 24.

Another component of the connector 18 is a wedge 36, which is formed from a thin, planar strip of metal, as is best seen in FIGS. 2–4. The wedge 36 includes an internal face 38 and an external face 40, which is opposed to the internal face 38. When the wedge 36 is inserted through the aperture 24 in the plate 22, as in FIG. 2, the internal face 38 is directed toward the upright 12, and the external face 40 is directed away from the upright 12. The faces 38, 40 are unparallel and thus provide a tapered shape to the wedge 36. As a result of this taper, the wedge 36 has a lower end 42 which is narrower than an upper end 44 of the wedge 36.

The wedge 36 is normally retained within a wedge support member 46 which is secured to either end of the horizontal spacers 14 and the diagonal spacers 16. A tubular adaptor 48 protrudes from the wedge support member 46 and may be secured to the spacers 14,16 in any number of ways which will be apparent to those skilled in the art.

The wedge support member 46 includes a substantially planar, rectangular base 50 which is secured to the end of the adaptor 48. A substantially planar upper leg 52 protrudes from the upper edge of the base 50 and extends radially inwardly, toward the upright 12. The upper leg 52 terminates in a curved surface 54 which conforms in shape to the exterior of the upright 12. Along the lower edge of the base plate 50, a substantially planar lower leg 56 is attached, and protrudes radially inwardly as well. Both the upper and lower legs 54,56 are substantially parallel and horizontally oriented. The legs 54,56 are spaced sufficiently to straddle the plate 22.

A lip 58 protrudes upwardly from the end of the lower leg 56 which is adjacent the upright 12. The lip 58 is substantially normal to the horizontal plane of the lower leg 56, and is curved to conform to the exterior of the upright 12. When viewed from the side, the wedge support member 46 has a substantially G-shaped outline.

A rectangular upper slot 60 extends through the upper leg 52, and a rectangular lower slot 62 extends through the lower leg 62. The slots 60,62 are vertically aligned as seen in FIGS. 2, 4 and 6, the wedge 36 extends through both the upper slot 60 and the lower slot 62 when the connector 18 is assembled.

The upper slot 60 is long enough to allow the narrow, lower end 42 of the wedge 36 to pass through, as is the lower slot 62. The wedge 36 is prevented from passing downwardly, completely through the upper slot 60, since the upper end 44 of the wedge 36 is too large to pass through the upper slot 60. The lower end 42 of the wedge 36 is prevented from being drawn upwardly through the upper slot 60 by means of a cylindrical pin 64. The pin 64 is pressed into a hole 66 through the lower end 42 of the wedge 36, after the lower end 42 has passed through the upper slot 60. The pin 64 is longer than the upper slot 60 is wide, and thus protrudes from the hole 66. After insertion of the pin 64, the lower end 42 of the wedge 36 cannot pass through the upper slot 60. As a result, the central portion of the wedge 36 is allowed to slide through the upper slot 60, yet the wedge 36 is still retained within the wedge support member 46. The lower slot 62 is wider than the upper slot 60, and as a result, the lower end 42 of the wedge 36, including the pin 64, can pass through the lower slot 62.

Preferably, the pin 64 is tubular, cylindrical, and includes a slot 68 which runs axially along the length of the pin 64. The slot 68 allows the outside diameter of the pin 64 to be decreased, facilitating insertion and withdrawal of the pin 64 from the hole 66. Normally, the pin 64 is in place within the hole 66 to retain the wedge 36 on the wedge support member 46 so that the wedge 36 does not have to be handled as a separate part. However, the pin 64 can be removed from the hole 66 to allow complete withdrawal of the wedge 36 through the upper slot 60 for repair or replacement of the wedge 36.

Figures 8, 9:
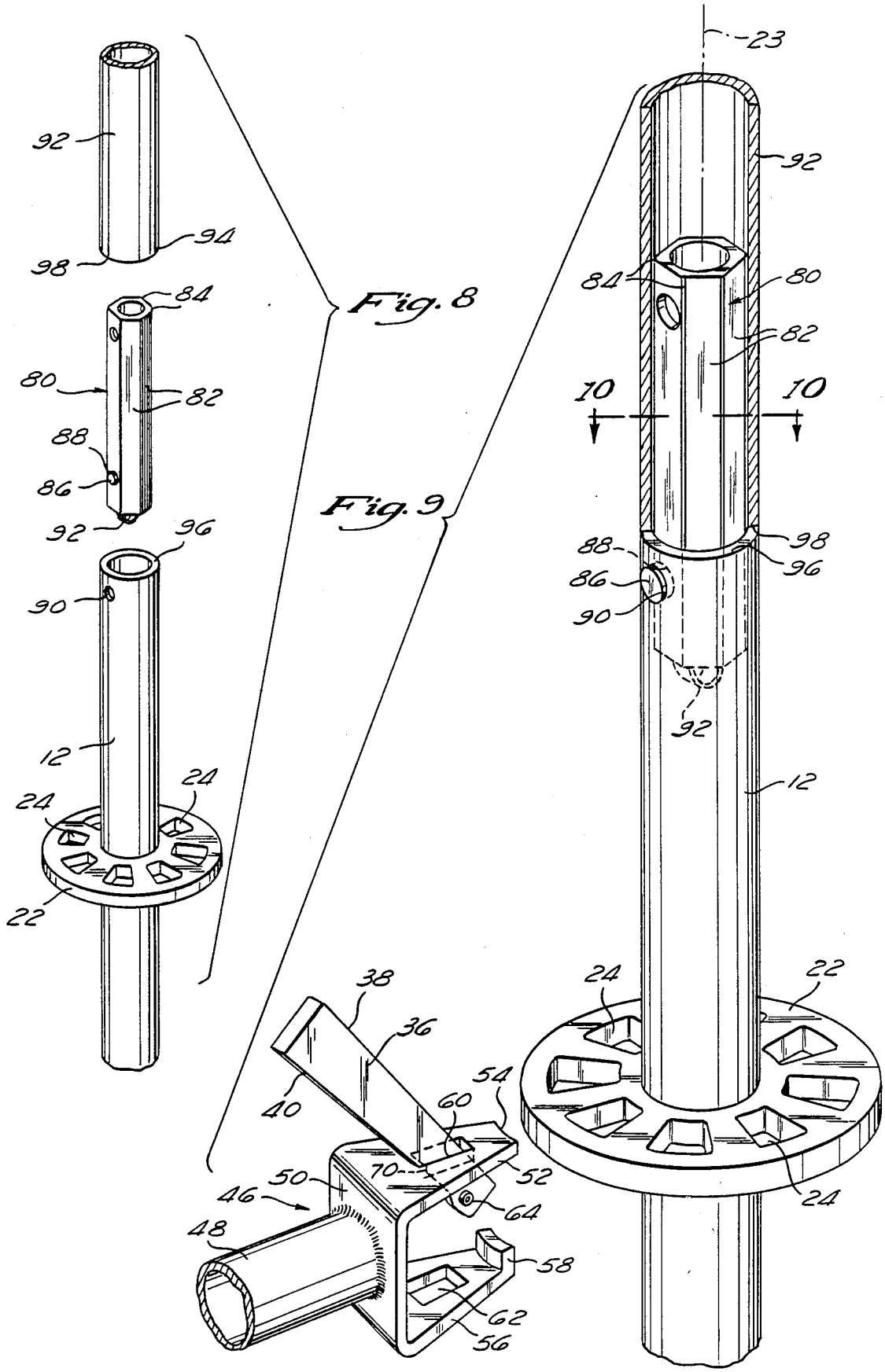
FIG. 8 is a partially cut away perspective view of two adjacent upright segments joined by a hexagonal head fitting according to the present invention, with the wedge shown in a tilted and raised position on the wedge support member.
FIG. 9 is an exploded perspective view of the adjacent upright segments and the head fitting of FIG. 8.

The wedge 36 includes a V-shaped notch 70 cut into the external face 40. As shown in FIG. 8, when the notch 70 is engaged with the perimeter of the upper slot 60, the wedge 36 is prevented from sliding downwardly and will be retained in a raised and tilted position in which the wedge 36 does not extend through the lower slot 62.

Turning now to FIG. 4, it can be seen that the wedge support member 46 further includes a U-shaped tooth 72 depending from the underside of the upper leg 52. The tooth 72 is formed from a front wall 74 and a pair of side walls 76 joined to either end of the front wall 74. The interior of the front and side walls 74, 76 partially surround the upper slot 60. The side walls 76 are tapered radially inwardly so that the exterior of the side walls 76 conform in size and shape to the narrow end 32 of the aperture 24. When the connector 18 is fully assembled, the tooth 72 is inserted into the aperture 24 so that the side walls 76 of the tooth 72 engage the side edges 30 of the aperture 24, and the front wall 74 of the tooth 72 engages the inner edge 26 of the aperture 24, as is best seen in FIG. 7.

In operation, the spacers 14, 16 are joined to an erect upright 12 by first manually grasping and positioning the spacer 14, 16 so that the wedge support member 46, which is on the end of the spacer 14, 16 are properly aligned with the plate 22 on the upright 12. Alignment is achieved when the wedge 36 can be inserted through the aperture 24. To facilitate alignment by a worker (not shown) who is holding the spacer 14, 16 the wedge 36 is placed in the tilted and raised position shown in FIG. 8. As a result, the wedge support member 46 can be positioned so that the upper leg 52 and lower leg 56 straddle the plate 22, without requiring an additional worker to hold the wedge 36 so that it does not extend through the lower slot 62, as in FIG. 4, and thus block the plate 22 from extending between the legs 52, 56.

Alignment of the wedge support member 46 and the plate 22 are readily indicated when the tooth 72 drops into the aperture 24, as seen in FIG. 5. Since the tooth 72 surrounds the upper slot 60, and the wedge 36 extends through the upper slot 60, mating of the tooth 72 with the aperture 24 ensures that the wedge 36 will be aligned for passage through the aperture 24. It is apparent to the worker who is holding the spacer 14, 16 that the tooth 72 is mating with the aperture 24, and thus a second worker is not required to visually inspect or manipulate the connector 18 to achieve alignment.

After the tooth 72 is positioned within the aperture 24, the wedge 36 is tilted forward to a vertically upright position, shown in FIG. 5, and allowed to drop through the upper slot 60. At this time, the tooth 72 is not fully engaged with the narrow end 32 of the aperture 24, and the lip 58 on the lower leg 56 is spaced slightly from the upright 12. To force the tooth 72 into the narrow end 32 of the aperture 24 so as to create a tight interference fit therebetween, the wedge 36 is driven downwardly by means of a hammer or other suitable tool (not shown).

Turning now to FIG. 6, as the wedge 36 is forced downwardly, through the lower slot 62, the external face 40 of the wedge 36 engages the external edge 28 of the aperture 24, and the internal edge 38 of the wedge 36 engages the front wall 74 of the tooth 72 and the upper leg 52. The increased width of the upper end 44 of the wedge 36 displaces the wedge support member 46 in a radially inward direction, so that the tooth 72 is wedged into the narrow end 32 of the aperture 24 to the position shown in FIGS. 6 and 7. Likewise, the lip 58 on the end of the lower leg 56 and the curved surface 54 on the end of upper leg 52 are moved radially inwardly into engagement with the exterior of the upright 12.

Advantageously, a rigid, stable connection is provided between the spacers 14, 16 and the upright 12 by the connector 18. The passage of the wedge 36 through the aperture 24 prevents the support member 46 from being pulled radially away from the plate 22. The contact between the tooth 72 and the perimeter of the aperture 24 prevents lateral motion of the spacers 14, 16 relative to the upright, or rotation of the spacers 14, 16 about the longitudinal axis of the upright 12. Further, the contact between the upper leg 52, lower leg 56 and the upright 12 prevents rotation of the spacer 14, 16 in a vertical plane. The lip 58 increases the surface area of the lower leg 56 in contact with the upright 12, thus decreasing the overall stress applied to the upright 12. As a consequence, larger loads can be supported by the spacers 14, 16 without causing damage to the upright 12.

The connector 18 is easily disassembled by driving the wedge 36 upwardly, until it is no longer extending through the aperture 24. At that point, the wedge support member 46 can be pulled away from the plate 22.

Although in the preferred embodiment the taper of the tooth 72 and the aperture 24 is directed radially inwardly, it is to be understood that the direction of the taper may be reversed while still obtaining the benefits of the engagement between the tooth 72 and the aperture 24 discussed above.

Turning now to FIGS. 1 and 8 through 10, a head fitting 80 is shown protruding from the upper end of the upright 12. The fitting 80 is substantially hexagonal in cross section and is formed from a plurality of rectangular, planar sides 82 which are joined by rounded corners 84. The outside diameter of the fitting 80, measured from corner to corner 84, is approximately equal to the inside diameter of the tubular upright 12.

The fitting 80 is secured to the upper end of the upright 12 by means of a circular button 86. The button 86 protrudes through a hole 88 in the fitting 80 and through a hole 90 in the upright 12 when the holes 88, 90 are aligned. The button 88 is biased to protrude through the holes 88, 90 by a leaf spring 92. The engagement between the button 86 and the hole 90 prevents axial motion of the fitting 80 relative to the upright 12, and also prevents rotation of the fitting 80 about its longitudinal axis, relative to the upright 12.

Since the fitting 80 contacts the interior of the upright 12 along each of the corners 84, the fitting 80 is unable to tilt relative to the upright 12. Thus, the fitting 80 remains vertical and coaxial with the upright 12 at all times, sharing a common longitudinal axis 23. If it is desired to remove the fitting 80 from the upright 12, the button 86 is depressed and the fitting 80 is slid axially out of the upright 12. Since the total surface area of contact between the fitting 80 and the upright 12 is small, little frictional resistance is encountered during withdrawal of the fitting 80.

The fitting 80 enables an adjacent upright 92 to the stacked vertically on top of the upright 12 to which the fitting 80 is secured, in order to increase the height of the scaffolding 10. The fitting 80 forms a male end of the upright 12, which is inserted into a female end 94 of the adjacent, tubular upright 92. Both uprights 12, 92 terminate in flat annular end surfaces 96, 98 which abut when the uprights 12, 92 are stacked.

Both of the uprights 12, 92 are of the same inside diameter, and thus, the effects of the engagement between the fitting 80 and either of the uprights 12, 92 is substantially the same. Contact between the corners 84 of the fitting 80 in the interior of the adjacent upright 92 maintain the uprights 12, 92 in a vertical, coaxial orientation. Insertion and withdrawal of the fitting 80 from the adjacent upright 92 is facilitated by the minimal friction between the fitting 80 and the adjacent upright 92.

What I claim is:

1. An apparatus for removably connecting a vertically upright first member and a second member, said apparatus comprising:

a plate surrounding said first member, at least one aperture extending through said plate, said aperture being tapered in a first direction and having a narrow end and a wide end along said first direction;

a first leg extending from said second member and adapted to rest on top of said plate;

a tooth depending from said first leg, said tooth extending into said aperture and being tapered in said first direction to conform in size and shape to said narrow end of said aperture; and means for forcing said tooth into said aperture narrow end along said first direction so as to prevent rotation of said second member in a horizontal plane about said first member.

2. The apparatus of claim 1 wherein said forcing means comprises a wedge which extends through said aperture, said wedge having a first face and a second face which are opposed and unparallel, said wedge being tapered so as to form a narrow end and a wide end of said wedge, said first leg including a slot therein through which said wedge extends.

3. The apparatus of claim 2 wherein as said wedge is driven through said aperture, said second face of said wedge engages said wide end of said aperture, and said first edge of said wedge engages said first leg.

4. The apparatus of claim 2, further comprising a second leg extending from said second member which is substantially parallel to said first leg, said second leg including a slot therein through which said wedge passes, one end of said second leg including a lip thereon which engages the exterior of said first member.

5. The apparatus of claim 2 wherein said wedge includes a hole at said narrow end and a removable pin extending through said hole, said pin being of a length to protrude from said hole and prevent said wedge from being drawn through said slot in said first leg.

6. The apparatus of claim 2, wherein said plate is substantially horizontally oriented.

7. The apparatus of claim 1 wherein said aperture is substantially trapezoidal and has a perimeter formed by a short edge and a long edge which are substantially parallel to each other, and a pair of tapered side edges which extend between said short edge and said long edge, said narrow end of said aperture defined by said short edge.

8. The apparatus of claim 7 wherein said tooth is substantially U-shaped, and is comprised of a front wall which engages said aperture short edge, and a pair of side walls which are tapered and which engage said aperture side edges.

9. The apparatus of claim 1 wherein said aperture is tapered in a radially inward direction, toward said first member.

10. An apparatus for removably connecting a first member to a second member, said apparatus comprising:

a plate attached to said second member, said plate having at least one aperture therein, said aperture having a perimeter defined by a first edge and a second edge and narrowing in width toward said first edge so as to form a narrow end, said edges being substantially opposed;

a wedge having a first face and a second face, said faces being substantially opposed and unparallel so as to provide a taper to said wedge;

a wedge support member on said first member through which said wedge passes, said wedge support member having a contact surface thereon which is engaged by said first face of said wedge;

a tooth mounted on said wedge support member, said tooth being shaped to conform to the perimeter of said narrow end of said aperture and extending at least partially into said aperture so as to properly align said wedge support member and said aperture; and said wedge extending through said aperture to secure said first member to said second member, said second face of said wedge engaging said second edge of said aperture as said wedge is driven into said aperture, said wedge first face displacing said wedge support member so as to cause said tooth to engage said narrow end of said aperture, thereby preventing rotational movement of said first member in a plane substantially parallel to the plane of said plate.

11. The apparatus of claim 10 wherein the perimeter of said aperture is substantially trapezoidal in shape, said first and second edges being substantially parallel, said first edge being shorter than said second edge, said first and second edges being joined by a pair of side edges.

12. The apparatus of claim 11 wherein said tooth is substantially U-shaped, and comprises a front wall and a pair of side walls, said walls corresponding in shape to said first edge and said side edges of said aperture.

13. The apparatus of claim 10 wherein the direction of displacement of said wedge support member is toward said second member.

14. The apparatus of claim 10 wherein said second member is a substantially elongated vertically oriented upright used in a scaffolding assembly, and said first member comprises an elongated, spacer member.

15. The apparatus of claim 10 wherein said wedge support member is secured to an end of said first member, said wedge support member comprising an upper leg and a lower leg which is substantially parallel to said upper leg, a slot extending through each leg, said wedge passing through said slots.

16. The apparatus of claim 15 wherein said lower leg terminates in a lip which extends substantially normal to said lower leg, said lip engaging the exterior of said second member, and shaped to conform to the exterior of said second member.

17. The apparatus of claim 15, wherein said tooth surrounds said slot in said upper leg.

18. The apparatus of claim 10 wherein said second face of said wedge includes a notch therein, said notch engaging said wedge support member to retain said wedge in a tilted and raised position in which said wedge does not extend completely through said aperture.

19. The apparatus of claim 10, wherein said plate is substantially planar and oriented substantially normal to the longitudinal axis of said second member.

20. A scaffolding connector apparatus which removably joins a vertical upright member and either a horizontal or diagonal spacer member, said apparatus comprising:

a substantially horizontal plate surrounding said upright member, said plate including at least one aperture therein, said aperture having a perimeter which is tapered radially inwardly so as to form a narrow end and a wide end, said narrow end adjacent said upright;

a wedge support member secured to an end of the spacer member, said wedge support member including a substantially planar upper leg and a substantially planar lower leg, said lower leg being substantially parallel to said upper leg and in a horizontal plane, said upper leg including an upper slot therein, and said lower leg including a lower slot therein, said slots being vertically aligned;

a tooth depending from said upper leg which is inserted into said aperture and which conforms in shape to the narrow end of the aperture, said tooth having walls which are tapered to conform to the tapered perimeter of said aperture; and a wedge which extends through said upper and lower slots and through said aperture to join said upright to said spacer, said wedge having a first face which is directed radially inwardly toward said upright, and a second face which is opposed and unparallel to said first face so that said wedge is tapered and has a narrow end and a wide end, wherein when said wedge is driven narrow end first, vertically downwardly through said aperture, said first face engages said wedge support member and said second face engages said wide end of said aperture so as to force said tooth into the narrow end of said aperture, said walls of said tooth engaging said aperture perimeter so as to prevent lateral movement of said spacer relative to said upright.

21. The apparatus of claim 20, wherein said lower leg includes a lip which extends upwardly substantially normal to said lower leg, said lip engaging the exterior of said upright, and conforming in size and shape to said upright exterior.

22. The apparatus of claim 21 wherein said tooth surrounds said upper slot.

23. The apparatus of claim 20, wherein said narrow end of said wedge includes a hole, a pin extending through said hole and being of a length so as to protrude from said hole and effectively increase the width of said wedge so that said wedge cannot be drawn upwardly through said upper slot, said pin being removable to allow said wedge to be drawn through said upper slot when desired.

24. The apparatus of claim 20, wherein said second face of said wedge includes a notch therein, said notch engaging the perimeter of said upper slot to permit said wedge to be retained in a raised and tilted position in which said wedge does not extend through said lower slot.

25. The apparatus of claim 20 wherein said upright terminates in a substantially flat, annular end surface, said apparatus further comprising:

an elongated head fitting extending through said open end and having a plurality of substantially flat sides, said sides joined by a plurality of rounded corners, the diameter of said head fitting being sized so that said corners engage the interior of said upright and the interior of an adjacent tubular upright member which rests on said annular end surface; and means for securing said head fitting to said upright.

26. The apparatus of claim 25 wherein said head fitting is substantially hexagonal in cross section.

27. A fitting for interconnecting a first cylindrical tubular member with a second cylindrical tubular member in a coaxial, end-to-end fashion, each of said tubular members terminating in an open end surrounded by an annular end surface, said end surfaces abutting, said first member connected to said second member by said fitting, said fitting being elongated and extending through the abutting ends of said first and second members, said fitting having a plurality of substantially planer sides which are joined by rounded corners, said corners engaging the interior cylindrical surface of each of said members so as to maintain said members in a coaxial orientation, while reducing friction so as to facilitate disassembly of said members.

28. The fitting of claim 27, wherein said fitting is substantially hexagonal in cross-section.

29. The fitting of claim 27, further comprising means for securing said fitting to said first member.

30. The fitting of claim 29, wherein said securing means comprises a hole through said first member and a hole through said fitting, a button extending through said hole in said fitting, said button protruding through said hole in said first member to prevent movement of said fitting relative to said first member, and means for biasing said button so as to protrude through said holes.

31. An apparatus for removably connecting a vertically upright scaffold first member with a horizontal second scaffold member, said apparatus comprising:

a plate extending radially outward from said first member;

a first leg extending from said second member and adapted to rest on top of said plate;

a first pair of tapered, non-parallel wedging surfaces formed on said first leg, said first pair of wedging surfaces tapered in a first direction;

a second pair of tapered, non-parallel wedging surfaces formed on said plate and conforming to the taper of said first pair of wedging surfaces, said second pair of wedging surfaces tapered in said first direction; and means for forcing said first pair of wedging surfaces into engagement with said second pair of wedging surfaces by displacing said leg relative to said plate along said first direction, so as to prevent rotation of said second member about said first member in a horizontal plane.

* * * * *